US009272190B2

(12) United States Patent
Tompkins

(10) Patent No.: US 9,272,190 B2
(45) Date of Patent: Mar. 1, 2016

(54) VOLLEYBALL COVER

(71) Applicant: Baden Sports, Inc., Renton, WA (US)

(72) Inventor: Hugh Tompkins, Renton, WA (US)

(73) Assignee: Baden Sports, Inc., Renton, WA (US)

( * ) Notice: Subject to any disclaimer, the term of this patent is extended or adjusted under 35 U.S.C. 154(b) by 0 days.

(21) Appl. No.: 14/581,974

(22) Filed: Dec. 23, 2014

(65) Prior Publication Data

US 2015/0174458 A1 Jun. 25, 2015

Related U.S. Application Data

(60) Provisional application No. 61/920,682, filed on Dec. 24, 2013.

(51) Int. Cl.
*A63B 43/00* (2006.01)
*A63B 41/08* (2006.01)

(52) U.S. Cl.
CPC ..... *A63B 43/00* (2013.01); *A63B 41/08* (2013.01); *A63B 2225/01* (2013.01); *A63B 2243/0095* (2013.01)

(58) Field of Classification Search
CPC .... A63B 43/00; A63B 41/08; A63B 2225/01; A63B 2243/0095
See application file for complete search history.

(56) References Cited

U.S. PATENT DOCUMENTS

| | | | | | |
|---|---|---|---|---|---|
| 4,000,894 | A * | 1/1977 | Butzen | A63B 41/08 | 473/596 |
| 4,239,568 | A * | 12/1980 | Takazawa | B29D 22/04 | 156/155 |
| 4,318,544 | A * | 3/1982 | Brine, Jr. | A63B 41/08 | 40/327 |
| 4,856,781 | A * | 8/1989 | Shishido | A63B 41/08 | 473/603 |
| D355,008 | S * | 1/1995 | Vitiello | D21/713 | |
| 5,669,838 | A * | 9/1997 | Kennedy | A63B 41/08 | 273/DIG. 8 |
| 5,851,161 | A * | 12/1998 | Sassak | A63B 41/08 | 442/149 |
| RE37,468 | E * | 12/2001 | Kennedy | A63B 41/08 | 473/596 |
| D500,104 | S * | 12/2004 | Lowinger | D21/698 | |
| 2003/0008736 | A1* | 1/2003 | Hung | A63B 41/08 | 473/598 |
| 2010/0009792 | A1* | 1/2010 | Ashida | A63B 41/08 | 473/604 |
| 2010/0137081 | A1* | 6/2010 | Ito | A63B 43/002 | 473/613 |
| 2010/0248873 | A1* | 9/2010 | Cooper | A63B 41/08 | 473/599 |

* cited by examiner

*Primary Examiner* — Steven Wong
(74) *Attorney, Agent, or Firm* — Bruce A. Kaser

(57) ABSTRACT

A volleyball cover is made of six equal panel sections. Each panel section is divided into two cover panels, making a total of twelve cover panels on the volleyball. Each cover panel has a plurality of dimples arranged in a uniform pattern across the cover panel. Cover panels are separated by very shallow skiving.

2 Claims, 4 Drawing Sheets

VOLLEYBALL COVER

TECHNICAL FIELD

The present disclosure relates to an improved cover for a volleyball.

BACKGROUND OF THE INVENTION

Volleyballs are typically made with "skived" panel sections. The "skive" is essentially a valley between adjacent ball panels that defines the boundary interface between the panels. Sometimes there is seam at the bottom of the skive; sometimes there is no seam, because one panel edge abuts directly against an adjacent panel edge.

When volleyballs are used for high-level game play, the volleyball server often likes a ball that can behave like a knuckleball during service. This is called a "float" serve, where the ball spins little or not at all, thus making it more difficult for the defending team to return. When the ball is in-play, players like volleyballs that can be "spiked" accurately and with high velocity.

The design disclosed below has features that are intended to improve over past volleyball cover designs relative to the functions described above.

SUMMARY OF THE INVENTION

A volleyball cover is made from six panel sections. The six panel sections are arranged on the volleyball such that each of the six sections are substantially equal in size.

The six sections are arranged on the cover as three symmetrical pairs of panel sections. One section of each pair is positioned on an opposite side of the volleyball cover relative to the other section of the pair. Each pair of sections has a unique color.

Each section is symmetrically divided into two cover panels of equal size. This makes a total of twelve cover panels making up the volleyball cover, each one of which is substantially identical in size (two cover panels per panel section, multiplied by six panel sections, equals a total of twelve cover panels). Twelve cover panels is a lesser number for regulation play volleyball, as per conventional volleyball specifications.

Each cover panel includes a plurality of circular dimples uniformly arranged on each cover panel. The circular dimples are arranged with a certain or preselected dimple density, preferably less than 500 dimples per cover panel (6,000 dimples per cover). Moreover, each circular dimple has a dimple diameter within the range of 1 to 4 millimeters. The dimples alter the aerodynamic characteristics of the cover.

Finally, each panel is separated from an adjacent panel by a reduced-depth or no-depth skive. Aerodynamic characteristics improve as the width and depth of the skived area between cover panels is reduced. The maximum width of the skive is no greater than 1 centimeter; and the maximum depth of the skive is no greater than 3 millimeters.

The above summary will become better understood upon review of the accompanying drawings and description.

BRIEF DESCRIPTION OF THE DRAWINGS

In the drawings, like reference numerals and letters refer to like parts throughout the various views, and wherein.

DETAILED DESCRIPTION

Figure 1:
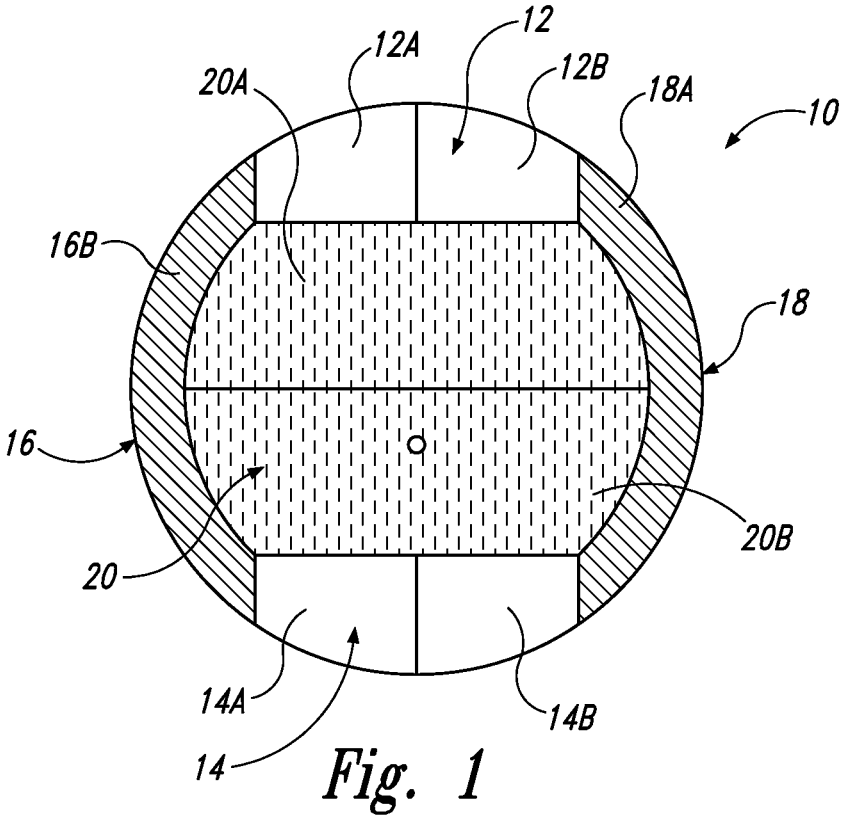
FIG. 1 is a frontal view of a volleyball cover constructed in accordance with the present disclosure.
Figure 2:
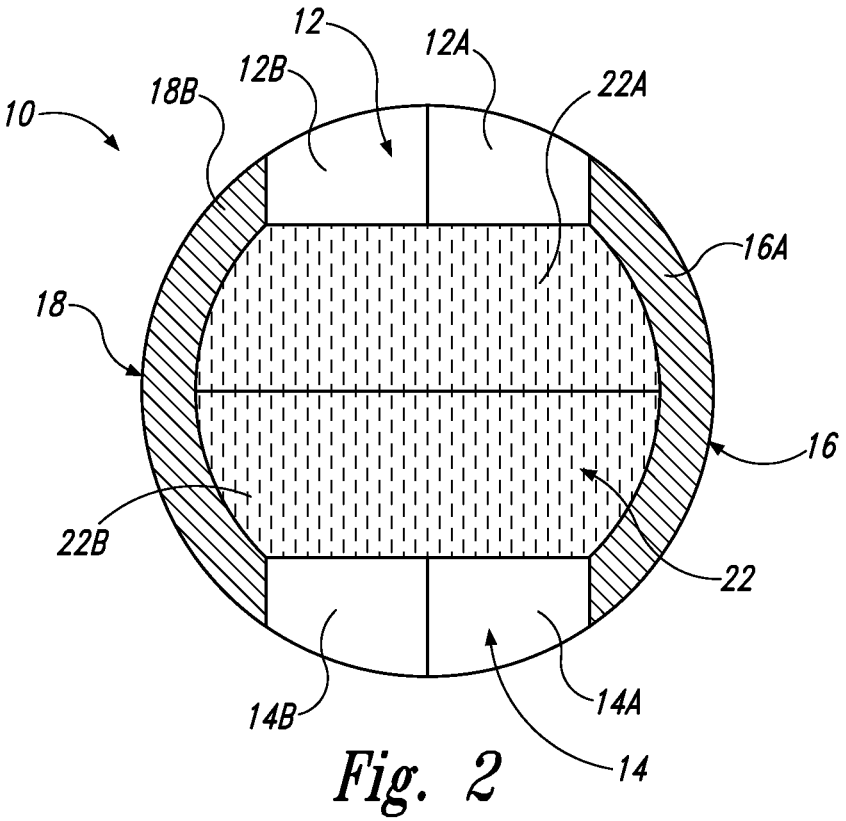
FIG. 2 is a back-side view of the cover shown in FIG. 1.
Figure 3:
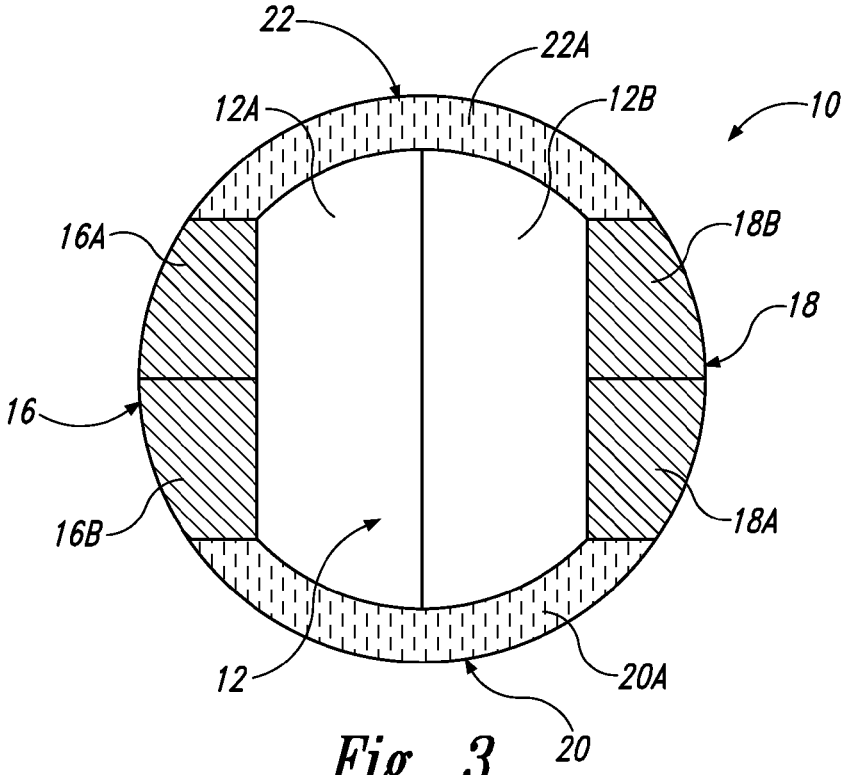
FIG. 3 is a top-side view of the cover shown in FIG. 1.
Figure 4:
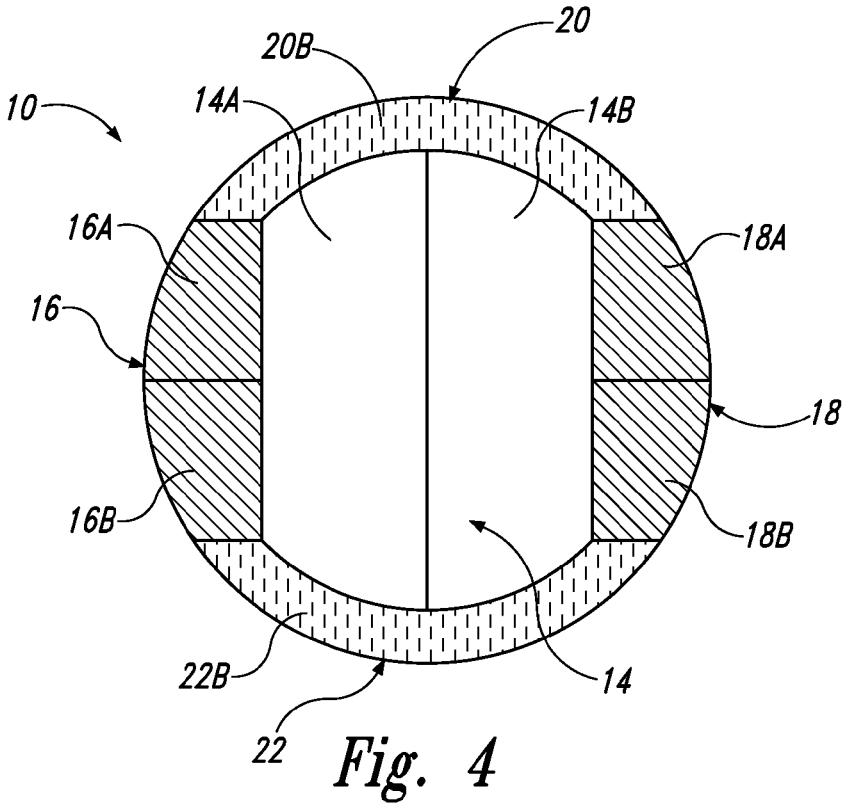
FIG. 4 is a bottom-side view of the cover shown in FIG. 1.
Figure 5:
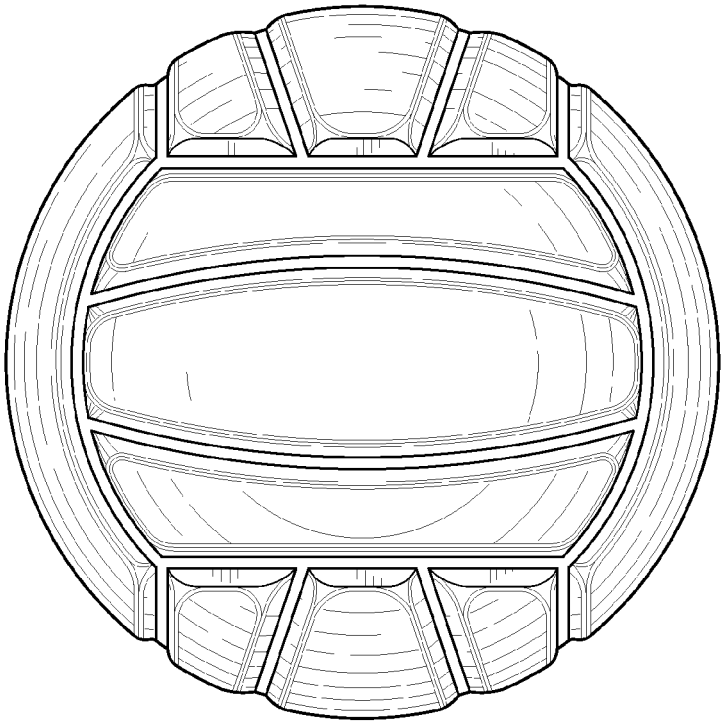
Fig. 5 (Prior Art)
FIG. 5 is labeled "prior art"

Referring now to FIG. 1, shown generally at 10 is a volleyball cover constructed in accordance with the present disclosure.

As summarized above, the volleyball cover comprises six panel sections, indicated generally by arrows 12, 14, 16, 18, 20, 22. In FIGS. 1-4, pairs of panel sections are shown as "white" or lined for the colors "green" or "purple," respectively. More specifically, panel sections 12, 14 are white; panel sections 16, 18 are purple; and sections 20, 22 are green. Colors are a matter of design choice or volleyball rule.

The six panel sections 12, 14, 16, 18, 20, 22 are arranged on the cover 10 as three symmetrical pairs of panel sections, one section of each pair being positioned on an opposite side of the volleyball cover relative to the other. In other words, section 12 is opposite section 14; section 16 is opposite section 18; and section 20 is opposite section 22.

Each colored panel section 12, 14, 16, 18, 20, 22 is symmetrically divided into two cover panels. Cover panels 12*a*, 12*b*, for example, make up panel section 12; cover panels 14*a*, 14*b* make up panel section 14; cover panels 16*a*, 16*b* make up panel section 16; cover panels 18*a*, 18*b* make up panel section 18; cover panels 20*a*, 20*b* make up panel section 20; and finally, cover panels 22*a*, 22*b* make up panel section 22.

Figure 6:
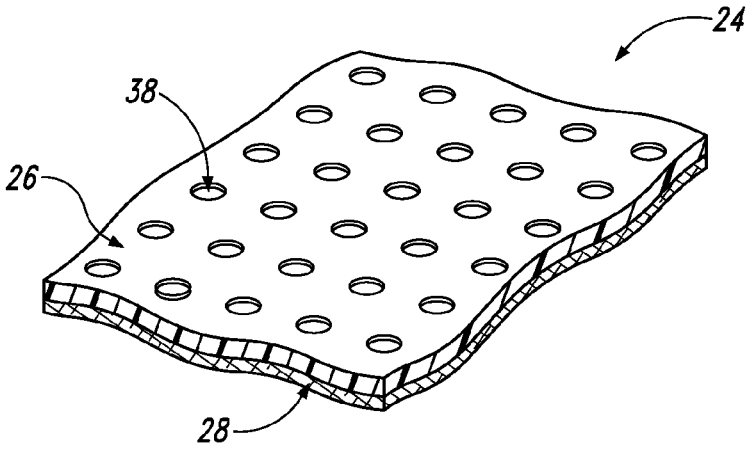
FIG. 6 is an enlarged sectional view of the volleyball cover material.

Referring now to FIG. 6, the make-up of the volleyball cover 10 will now be described. Reference numeral 24 generally indicates the volleyball cover or one panel. The volleyball cover 24 includes an outer layer of polyurethane material 26 laid upon a microfiber backing 28.

The polyurethane layer 26 has a plurality of dimples that are uniformly placed on the polyurethane layer, such that they are either symmetrical or in an equidistant relationship to each other. Although the density may be greater (as high as 500 dimples per cover panel), or lesser, the present version of the volleyball cover disclosed here has approximately 400 dimples per cover panel 12*a*, 12*b*, 14*a*, 14*b*, 16*a*, 16*b*, 18*a*, 18*b*, 20*a*, 20*b*, 22*a*, 22*b*. Therefore, in this specific example, the volleyball cover (for one volleyball) would have a total of approximately 4,800 dimples (400 dimples per panel multiplied by 12 panels).

Each dimple is circular and less than 3 mm. in diameter. The dimple depth is sufficient to impact the airflow characteristics on the cover, and depth may be a variable, but its nevertheless recessed relative to a smooth cover. The thickness of the polyurethane layer 26 ranges approximately from 1 to 2 millimeters in thickness. Similarly, the microfiber backing 28 may be 1 to 2 millimeters thick. These dimensions are variables and may change. The cover panels 24 are applied (as the combination of polyurethane layer 26 and backing 28) to the underlying volleyball carcass.

Figure 7:
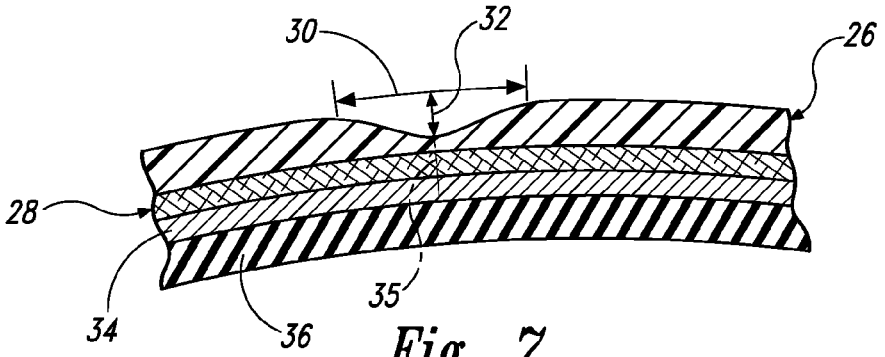
FIG. 7 is a cross-sectional view of a volleyball with the volleyball cover, from the outer surface to the inner bladder.

Referring now to FIG. 7, which illustrates the reduced skive or "no skive" region in the volleyball cover 10, arrow 30 indicates the maximum width of the skive, which should be less than 1 centimeter. Arrow 32 indicates maximum skive depth, which should be less than 3 millimeters. FIG. 7 provides a better idea as to how little the skiving should impact the cover, with arrow 33 pointing to the region where the skive is located. Arrow 35 indicates the break between individual cover panels.

Figure 8:
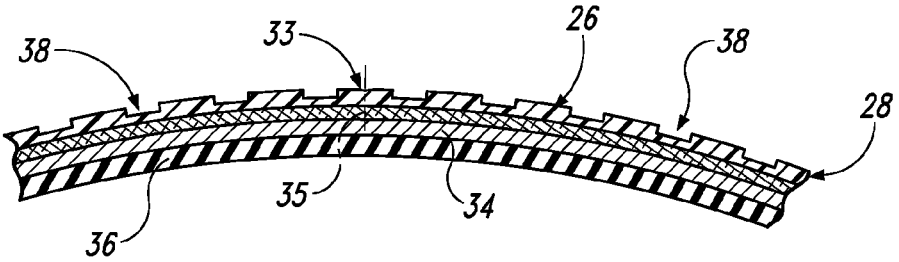
FIG. 8 is a cross-sectional view similar to FIG. 7, but shows the dimples in the outer volleyball cover.

FIG. 8 illustrates the cross-section of a volleyball, with the cover 10, including polyurethane and microfiber layers 26, 28. Underneath the microfiber layer 26 is a layer of cloth wrap 34. Below the cloth wrap 34 is a rubber bladder 36. Dimples are generally indicated by arrows 38 in FIGS. 6 and 8.

The volleyball is constructed in a conventional manner. The bladder 36 is surrounded with cloth wrap 34 that is attached by saturating the wrap with a glue, such as latex glue, for example. After this is done, the volleyball cover 24 (as shown in FIG. 6) is hand-laid onto the wrap 34 (each cover panel of the entire cover is bonded to the wrap) and adhesively bonded with only a shallow or barely any skive between individual cover panels.

The combination of fewer cover panels, reduced skiving, and dimpling, provides an improved volleyball cover for gameplay.

It is to be appreciated that the foregoing description is not to be taken in a limiting sense. Instead, the scope of patent protection is to be limited only by the patent claim or claims allowed by the U.S. Patent Office, the interpretation of which is to be made in accordance with the established doctrines of patent claim interpretation.

What is claimed is:

1. A volleyball cover, comprising:

six panel sections arranged on the volleyball cover, with each section of said six sections being substantially equal in size, said six panel sections being arranged on the cover as three symmetrical pairs of panel sections, with one section of each pair being positioned on an opposite side of the volleyball cover relative to the other section of said pair, and further, each panel section is symmetrically divided into two cover panels, and still further, each cover panel includes a plurality of circular dimples uniformly arranged on each cover with a certain dimple density, with each circular dimple having a dimple diameter within the range of 1 to 4 millimeters, and still further, said certain dimple density is less than 500 dimples per each cover panel, and still further, each panel is separated from an adjacent panel by a reduced-depth skive, with the maximum width of the skive being no greater than 1 centimeter and the maximum depth of the skive being no greater than 3 millimeters.

2. The volleyball cover of claim 1, wherein the dimple density of each cover panel is approximately 400 dimples per cover panel.

* * * * *